United States Patent [19]

Bonanno et al.

[11] 4,009,657

[45] Mar. 1, 1977

[54] APPARATUS FOR APPLYING FLUID TO AN INTAGLIO ROLL FOR TRANSFER TO A SOFT, ABSORBENT FIBROUS WEB

[75] Inventors: Frank Joseph Bonanno, Secane; Richard B. Kaiser; Pieter J. Kroon, both of Swarthmore, all of Pa.

[73] Assignee: Scott Paper Company, Philadelphia, Pa.

[22] Filed: Feb. 25, 1975

[21] Appl. No.: 552,948

[52] U.S. Cl. ..... 101/157; 101/169; 101/366

[51] Int. Cl.[2] ..... B41F 9/10

[58] Field of Search ..... 101/350, 349, 157, 169, 101/363, 364, 366

[56] References Cited

UNITED STATES PATENTS

| | | | |
|---|---|---|---|
| 1,981,912 | 11/1934 | Fankboner | 101/169 X |
| 2,272,406 | 2/1942 | Gurwick | 101/157 X |
| 2,371,223 | 3/1945 | Crafts | 101/157 |
| 2,376,620 | 5/1945 | Piazze | 101/157 |
| 2,447,090 | 8/1948 | Pollock | 101/169 |
| 2,573,336 | 10/1951 | Holmwood | 101/157 X |
| 2,676,539 | 5/1954 | Behringer | 101/366 X |
| 2,869,460 | 1/1959 | Worthington | 101/366 |
| 3,017,828 | 1/1962 | Behringer | 101/157 |
| 3,205,816 | 9/1965 | Heimlicher | 101/366 |
| 3,236,178 | 2/1966 | Worthington et al. | 101/366 X |
| 3,288,061 | 11/1966 | Doyle | 101/366 X |
| 3,595,168 | 7/1971 | Klingler | 101/350 |
| 3,641,932 | 2/1972 | Behringer | 101/366 X |
| 3,756,152 | 9/1973 | Abler | 101/157 X |

*Primary Examiner*—Edgar S. Burr
*Assistant Examiner*—Paul J. Hirsch
*Attorney, Agent, or Firm*—Joseph H. Yamaoka; William J. Foley

[57] ABSTRACT

Disclosed is a method and apparatus for applying fluid to an intaglio roll for subsequent transfer to a soft, absorbent fibrous web passing in contact with the intaglio roll. The fluid is flowed upwardly through a small unpressurized reservoir extending across the width of the intaglio roll, which forms a confining member of the reservoir, and overflows a second confining member of the reservoir spaced from the intaglio roll. The fluid is flowed into the reservoir with uniform flow velocity profile across the width of the reservoir, created preferably by flowing the fluid against an impingement member prior to entering the reservoir. The intaglio roll is rotated upwardly through the reservoir to establish a first layer of fluid adhering to the roll above the reservoir, and the intaglio roll is rotated past a unique pre-wipe member positioned adjacent the intaglio roll above the reservoir. The pre-wipe member uniformly distributes the fluid in the first layer across the width of the intaglio roll, assures filling the fluid carrying recesses with the fluid, and establishes a reformed layer of fluid adhering to the roll above the pre-wipe member, the reformed layer having less thickness than the first layer. The intaglio roll is then rotated past a doctor blade positioned against the intaglio roll beyond the pre-wipe member to remove essentially all of the fluid adhering to the intaglio roll except the fluid within the fluid carrying recesses.

14 Claims, 1 Drawing Figure

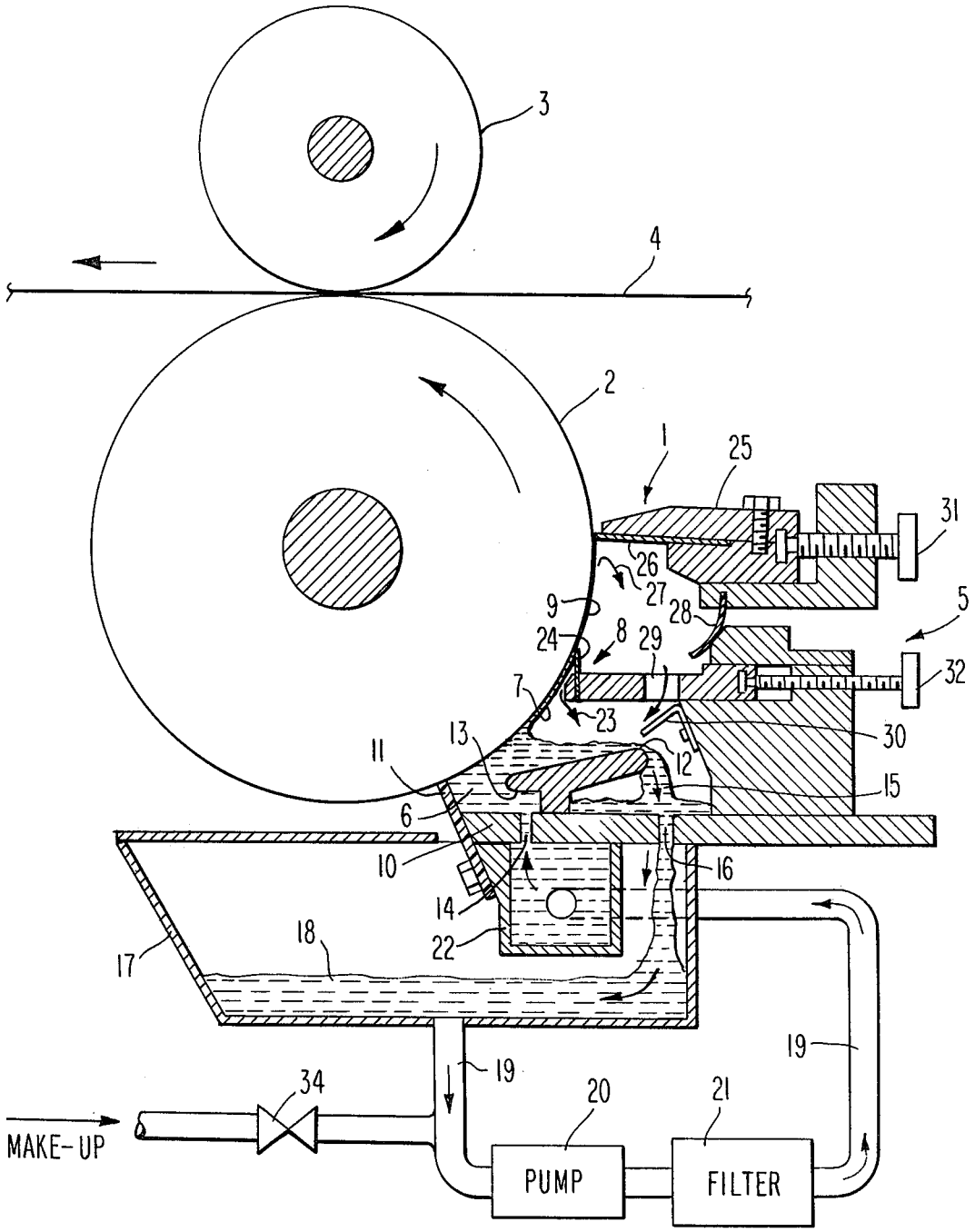
3
4
2
1
25
31
26
27
28
5
9
24
8
29
32
7
23
30
13
11
12
15
6
10
16
14
22
18
17
19
19
34
20
21
MAKE-UP
PUMP
FILTER

APPARATUS FOR APPLYING FLUID TO AN INTAGLIO ROLL FOR TRANSFER TO A SOFT, ABSORBENT FIBROUS WEB

BACKGROUND OF THE INVENTION

1. Field of the Invention

The invention relates to the field of fluid application in a pattern to fibrous webs, and particularly to applying bonding materials or adhesives in fluid form to a soft, absorbent fibrous web, such as sanitary paper, by way of an intaglio roll.

2. Description of the Prior Art

In making nonwoven fibrous products, and to an increasing extent paper products, bonding materials or adhesives are added to the webs to strengthen them. Examples of adhesively bonded paper products for which the invention is applicable are disclosed in U.S. Pat. No. 3,821,068 and British Pat. No. 1,294,794. Typically, the adhesive is applied to the web with conventional printing apparatus, in which the adhesive is applied in fluid form to gravure or intaglio rolls, which are in turn rotated into contact with a passing fibrous web to which the adhesive is applied in the pattern of the fluid carrying recesses in the surface of the intaglio roll. However, conventional printing apparatus have not been entirely satisfactory due to their shortcomings in handling fluids which are more viscous (up to 600 CPS, for example) and more subject to deterioration than the inks for which the apparatus were designed. Additionally, being designed to print upon coated or sized paper, conventional printing apparatus are unable to control the loose fibers which are inadvertently picked from the soft, absorbent fibrous webs by the intaglio roll and carried into the fluid application zone. Even the use of conventional trash doctors positioned against the intaglio roll at a position beyond where the roll contacts the web and before the fluid application station are not entirely effective, because the fibers are carried in the fluid carrying recesses past the trash doctor.

One form of conventional printing apparatus is illustrated in U.S. Pat. Nos. 1,812,884; 2,338,561; 2,371,223; and 2,631,532. In that form of apparatus, the fluid is applied to the intaglio roll by rotating the roll through a large open bath of the fluid. The "open bath" type of applicator is not satisfactory for the application of adhesives to soft, absorbent fibrous webs, because the adhesives are deteriorated by excess exposure to air in the large bath and because loose fibers from the web accumulate in the bath of fluid and substantially increase the apparent viscosity of the fluid which reduces the ability to apply the fluid uniformly without fiber contamination to all fluid carrying recesses.

Another form of conventional printing apparatus is disclosed in U.S. Pat. Nos. 2,177,656 and 3,641,932. In that form of apparatus the fluid is applied through a pressurized fountain against a small zone of the rotating intaglio roll. The "fountain type" apparatus can be undesirably sensitive to the angle of application and velocity of the fluid applied to the intaglio roll.

An additional form of conventional printing apparatus is described in U.S. Pat. Nos. 2,655,102 and 3,630,146 and consists of a small reservoir of fluid positioned against the downwardly moving surface of the intaglio roll. This form of apparatus does not have the ability to prevent loose fibers from accumulating in the fluid.

Another form of conventional printing apparatus is a modified fountain arrangement in which the fluid is pumped under pressure through a long conduit-like zone against the intaglio roll. Illustrations of this form of apparatus can be found in U.S. Pat. Nos. 2,376,620 and 2,573,336. It has to a large degree the same shortcomings as the "fountain type" apparatus.

In addition to the above-stated shortcomings of the prior art conventional printing apparatus for use in applying adhesives to soft, absorbent fibrous webs, the prior art apparatus have difficulty uniformly filling all fluid carrying recesses with adhesives without leaving excess adhesive on the surface of the intaglio roll. This difficulty is due to such causes as uneven spreading of fluid across the width of the intaglio roll and turbulent flow of the fluid against the intaglio roll, both of which increase at the high speeds desirable for commercial operation.

In view of the shortcomings of the prior art, it is an object of the invention to provide an improved method and apparatus for applying adhesive fluid to an intaglio roll for transfer to a soft, absorbent fibrous web at high speeds without the above-described disadvantages.

SUMMARY OF THE INVENTION

The invention overcomes the shortcomings of the prior art with a unique small, unpressurized reservoir for applying fluid to the intaglio roll and with unique pre-wipe means for assuring that all fluid carrying recesses are filled with adhesive and that the final removal of excess adhesive from the surface of the intaglio roll is accomplished efficiently, even at high speeds. Specifically, the apparatus comprises confining members forming a small unpressurized reservoir of the adhesive fluid extending across the width of the intaglio roll, pre-wipe means positioned axially across the width of the intaglio roll above the reservoir, and a doctor blade positioned axially against the intaglio roll above the pre-wipe means. The intaglio roll rotates upwardly through the reservoir to form a first layer of the fluid adhering to the intaglio roll above the reservoir. The pre-wipe means, which preferably includes a wiping surface disposed at an acute angle to the surface of the intaglio roll, forces the fluid in the first layer into the fluid carrying recesses of the intaglio roll and establishes a reformed, thinner and more uniform layer of the fluid adhering to the intaglio roll above the pre-wipe means. The doctor blade removes essentially all of the fluid adhering to the intaglio roll except the fluid within the fluid-carrying recesses.

For purposes of understanding the term "unpressurized reservoir", it is best described as a reservoir of fluid subjected to only atmospheric pressure at the surface, having no significant head pressure anywhere in the reservoir (because of its small depth), and having no significant pressure necessary to overcome energy losses attendant with high velocity movement of fluid through the reservoir.

The thickness of the first layer of adhesive is estimated to be in the range of about 0.025 inch to about 0.050 inch, and the thickness of reformed layer is preferably in the range of about 0.005 inch to about 0.010 inch. The amount of fluid remaining on the surface (not the fluid carrying recesses) of the intaglio roll 2 after passing the doctor blade is preferably in the range of about 0.00075 inch to about 0.001 inch. When stating that "essentially all" of the fluid is removed from the surface, it is contemplated that an amount within that range or less will be left on the surface.

The confining members forming the unpressurized reservoir are provided by a portion of the intaglio roll, a level control member spaced from the intaglio roll and over which the fluid flows, a lower sealing member positioned close to the intaglio roll below the surface of the reservoir and end confining members. The invention further includes means for flowing the fluid upwardly through the reservoir at uniform velocity profile across the width of the reservoir and over the level control member to flush loose fibers from the reservoir. The overflowed fluid is preferably recirculated by a pump through a filter to remove the fibers and back into the reservoir. In a preferred form of the apparatus, the pre-wipe means is provided by a thin flexible blade which forms an angle with the surface of the intaglio roll of from about 15° to about 55° and with the vertex of the angle in the direction of roll movement. The pre-wipe blade is similar to the doctor blade, but has greater flexibility than the doctor blade so that it removes only a portion of the fluid layer adhering to the intaglio roll. In doing so it reforms a more uniform thinner layer of fluid on the roll to be removed by the doctor blade. The reduced amount of fluid acting on the doctor blade reduces hydraulic forces on the doctor blade, which permits the use of less pre-load force pressing the blade against the surface of the intaglio roll, resulting in less wear on the roll.

BRIEF DESCRIPTION OF THE DRAWING

The drawing illustrates the preferred apparatus of the invention in a cross-sectional elevation view looking along the rotation axis of the roll. The configuration of the apparatus at all positions along the axis except the ends is essentially identical to that illustrated.

DESCRIPTION OF THE PREFERRED EMBODIMENTS

Referring to the drawing, the apparatus with which the invention is used includes intaglio roll 2 rotatably mounted in nipping relationship with rotatable pressure roll 3 and rotatably driven by conventional motor means (not shown). The web 4 to which the adhesive fluid is applied is passed through the nip formed by intaglio roll 2 and pressure roll 3. The fluid application means of the invention is designated by indicating numeral 5 and includes unpressurized reservoir 6, pre-wipe means 8, and doctor blade means 1.

In operation, the intaglio roll 2 rotates upwardly through reservoir 6, carrying with it a first layer 7 of the fluid adhering to the intaglio roll 2 above the reservoir 6. As the intaglio roll rotates past pre-wipe means 8, most of the adhesive in first layer 7 is wiped from the intaglio roll 2, leaving a reformed layer 9 of the remaining fluid adhering to the intaglio roll 2 above the pre-wipe means 8. The reformed layer 9 of fluid is much thinner than the first layer 7 of the fluid, and is more uniform in thickness across the width of the intaglio roll 2. While removing excess adhesive from the first layer 7, the pre-wipe means 8 forces fluid into any fluid-carrying recesses which are not already filled. The removed excess adhesive is flowed back from the intaglio roll 2 by the pre-wipe means and returned to the reservoir 6, as indicated by flow arrow 23.

As the intaglio roll 2 rotates past the doctor blade means 1, the reformed layer 9 of fluid is wiped from the intaglio roll 2 by doctor blade 26, leaving the fluid only essentially in the fluid carrying recesses of the intaglio roll 2. The excess fluid wiped from reformed layer 9 is flowed back away from the intaglio roll 2 as indicated by flow arrow 27 and returned to reservoir 6. During operation of the apparatus, the fluid is continuously flowed through reservoir 6 in an upward direction and over level control member 12. The fluid overflowing level control member 12 is flowed in the direction of arrow 15 into a recirculation system, which conducts the fluid through a filter to remove loose fibers which have accumulated in the fluid and returns it to reservoir 6. In order to provide uniform flow velocity profile across the width of the reservoir 6, the fluid is flowed into the reservoir 6 by way of apertures 14 in bottom plate 10 and against impingement member 13, where the fluid is uniformly disbursed across the width of the reservoir 6 and any excessive fluid velocity is dissipated before the fluid enters reservoir 6.

Having generally described the apparatus and method of the invention, the preferred details of each of the elements will now be described, starting with the unpressurized reservoir 6. The reservoir 6 is formed by confining members comprising a portion of the lower quadrant of intaglio roll 2, level control member 12, and lower sealing member 11. Conventional end deckles (not shown) function as end confining members to prevent flow of the fluid from the reservoir 6 at the ends of the intaglio roll 2. The end deckles are preferably provided by plates sealingly secured to the ends of bottom plate 10, sealing member 11, and level control member 12. The plates, preferable made from nylon or teflon, are positioned against the circumferential surface of the intaglio roll 2, and extend upward at least to the pre-wipe means 8. Level control member 12 is formed by a member spaced from the intaglio roll 2 and extending across the width of the intaglio roll 2. The level control member 12 slopes upwardly and away from the intaglio roll 2 so that the fluid in reservoir 6 can be flowed over the member 12 without encountering flow pockets to trap fibers. Lower sealing member 11 is positioned below the surface of the reservoir 6 and close to intaglio roll 2. The drawing illustrates a bottom plate 10 as forming a confining member of the reservoir, but it could be a part of sealing member 11 or may not even be necessary with particular sealing member 11 configurations.

In a preferred embodiment of the invention, level control member 12 includes a projection extending towards intaglio roll 2 and having a flat surface on the bottom of the projection to form an impingement member 13 facing the aperatures 14. In order to be an effective impingement member, the flat surface must be disposed at an abrupt angle to the fluid flow direction, preferably between 45° and 135° and even more preferably at 90°. Reservoir 6 begins just beyond the open edge of impingement member 13. Lower sealing member 11 is preferably provided by a non-abrasive material such as teflon or nylon and is spaced from the intaglio roll 2 by a distance sufficiently small so that the movement of the intaglio roll past sealing member 11 will prevent leakage of the fluid past the sealing member 11.

As an illustration of the preferred size of reservoir 6, the following dimensions are considered suitable for use with a typical intaglio roll 2 having a diameter between 12 inches and 24 inches. The reservoir 6 is preferable between about 2 inches and about 4 inches deep. The reservoir 6 extends away from intaglio roll 2 about ¼ inch to ½ inch at the bottom of level control member 12 and about 2 inches to 3 inches at the top of level control member 12. The width of reservoir 6 is, of course, equal to the width of the portion of intaglio roll 2 to which the fluid is applied.

The pre-wipe means 8 is provided by a plate-like member mounted in a horizontal plane and extending axially across the surface of the intaglio roll 2. The wiping end of the pre-wipe member is positioned through use of conventional adjustment screws 32 (of which only one is shown) parallel to the surface of the intaglio roll 2 at a predetermined desired spacing. The wiping surface of the pre-wipe means 8, which is that portion closest to the surface of the intaglio roll 2, is disposed at an acute angle to the roll 2 surfce. In the preferred embodiment, the wiping surface of pre-wipe means 8 is provided by a thin flexible blade 24 mounted near the end of the plate-like member and extending generally vertically towards the intaglio roll 2. The spacing of the pre-wipe blade 24 from the intaglio roll 2 surface is dependent upon the desired thickness of the reformed layer 9 of fluid desired. The pre-wipe blade 24 is preferably made from a material which does not excessively wear the expensive intaglio roll 2 surface in the event the blade 24 contacts the surface. Examples of useful material are phosphor bronze and beryllium copper, preferably heat treated to give it spring-like characteristics. The blade is preferably between about 0.010 inch and 0.020 inch thick. The flexibility of the pre-wipe blade 24 is determined by the bending modulus of the blade 24 material, the thickness of the blade, the length of the blade 24 extending beyond its mounting or backup support, and the angle formed by the blade 24 and the surface of the intaglio roll 2.

It is preferable that the acute angle formed between pre-wipe blade 24 and the surface of the intaglio roll 2 be between about 15° and about 55°. For purposes of determining this angle, the surface of the intaglio roll 2 is taken as the tangent to the point on the roll 2 closest to the end of the pre-wipe blade 24. With an acute angle formed between the pre-wipe blade 24 and the roll 2 surface, the fluid in first layer 7 is forced into a wedge-shaped zone formed at the end of the pre-wipe blade 24 between it and intaglio roll 2 surface. The fluid in this wedge-shaped zone is under a pressure created by the constant flow of additional fluid into the zone. Hydrodynamic bearing lubrication theory can be applied to calculate the pressure forces developed within this wedge-shaped zone. The pressure in the wedge-shaped zone produces several beneficial effects. It spreads the fluid uniformly across the width of the intaglio roll 2 in the wedge-shaped zone, which in turn reforms beyond the pre-wipe means 8 another fluid layer 9 of more uniform but lesser thickness across the width of the intaglio roll 2, and it forces the fluid into any fluid carrying recesses which have not already been filled.

The pressure in the wedge-shaped zone produces the further benefit of forcing the flexible pre-wipe blade 24 away from the surface of the intaglio roll 2, particularly if it was positioned very close at initial set up before beginning operation. Thus, the initial set up of the pre-wipe blade 24 against the intaglio roll 2 before beginning operation can be made by actual contact of the blade against the intaglio roll 2. This ability to contact the intaglio roll 2 surface with the pre-wipe blade 24 can be useful in permitting quick and accurate alignment of the blade 24 with the surface of the intaglio roll 2. Furthermore, the flexibility of the pre-wipe blade 24 permits passage beyond the pre-wipe means 8 of any fiber clumps which might have escaped the cleansing effect of the reservoir overflow. Without this ability, the fiber clumps would plug the opening between the intaglio roll 2 and the pre-wipe blade 24, creating a circumferential streak of unfilled fluid carrying recesses.

Doctor blade means 1 are provided by doctor blade holder 25 mounted axially across the surface of the intaglio roll 2 and adjustable through a plurality of conventional adjustment screws 31 (of which only one is illustrated) to position doctor blade 26 in contact with the intaglio roll 2 surface. Doctor blade 26 is, like pre-wipe blade 24, preferably made from a thin flexible material which does not excessively wear the intaglio roll 2 surface. The flexibility of doctor blade 26 is chosen to be less than (preferably less than 1/5) that of pre-wipe blade 24, so that it can wipe essentially all of reformed layer 9 of the fluid from the surface of the intaglio roll 24. Of course, the fluid within the fluid carrying recesses is left intact. The angle formed by the doctor blade 26 and the surface of the intaglio roll 2 (as determined by the tangent to the surface where doctor blade 26 touches) is larger, preferably between about 75° and about 85°, than the corresponding angle for the pre-wipe blade 24. The vertex of the angle is, as is true with the pre-wipe blade 24, in the direction of roll movement.

The flexibility of the doctor blade 26 is, like the pre-wipe blade 24, a function of the bending modulus of the blade 26 material, the thickness of the blade 26, the length of the blade 26 extending beyond its mounting or backup support, and the angle formed by the blade 26 and the surface of the intaglio roll 2 (tangent to the surface at point of contact). The angle formed by the blade 26 and intaglio roll 2 surface affects the amount of movement or displacement of the blade back from the surface, since the principal direction of deflection is perpendicular to the blade rather than directly away from the intaglio roll 2 surface. "Flexibility" for purposes of understanding the invention can be described in terms of the amount of blade displacement from the intaglio roll surface per unit force (which results from the pressure of the fluid against the blade) applied normal to the blade, and it can be approximated by the following formula:

$X/F = \cos \alpha \, L^3/3EI$, where $X$ = displacement of blade tip from roll surface, in.

$F$ = force causing deflection normal to blade, lbs.

$\alpha$ = angle between blade and tangent of roll surface at closest point to blade, degrees.

$L$ = length of blade extending beyond backup or support, in.

$E$ = Young's modulus, lbs./in.$^2$ $I$ = moment of inertia of a cross-sectional segment of the blade taken about the axis parallel to the rotational axis of intaglio roll, in.$^4$ The fluid recirculation system includes drainage openings 16 in the bottom plate 10 to conduct the fluid overflowing the reservoir 6 into accumulating tank 17. The fluid in accumulating tank 17 is pumped through conduit 19 and filter 21 by pump 20 and into distribution conduit 22, from where it is flowed through apertures 14 against impingement member 13 and back into reservoir 6. Distribution conduit 22, apertures 14, and impingement member 13 are conventionally designed to enhance the uniformity of fluid flow velocity profile across the width of the reservoir 6. Such conventional design considerations are discussed in U.S. Pat. Nos. 3,298,905; 3,652,391; and 3,802,960. For purposes of understanding the invention, velocity profile as defined as the profile formed by the magnitude of the local stream velocities of fluid at each location across the width of the flow stream, which in this case is the width of the reservoir 6. The degree of uniformity required by the invention is that which does not include localized variations of flow velocity which deleteriously affect the formation of first layer 7 of fluid.

Filter 21 is a conventional filter of a size chosen to remove loose web fibers from the fluid without creating excessive working or pressure loss of the fluid passing through. A portion of the fluid is removed from the system by being applied to the web 4, and make-up fluid is brought into the system through valve 34, which can be operated by conventional automatic means or be hand operated periodically.

The amount of fluid circulated through the reservoir 6 and overflowing the level control member 12 is at least ¼ g.p.m. for each linear inch of reservoir 6 or intaglio roll 2 width. The overflow rate is preferably between ⅓ and ¾ g.p.m. per linear inch. This amount of overflow has been found adequate for flushing loose fibers from reservoir 6 of adhesive where conventional paper webs are being passed through the apparatus. The amount of overflow desired could be larger or smaller for other webs which tend to have more or less fibers picked off by the intaglio roll 2.

Within the fluid applicator 5, the excess fluid wiped from the first fluid layer 7 by the pre-wipe means 8 is flowed back from the intaglio roll 2 along the bottom of pre-wipe means 8 from where it drops back or is conducted back by deflector member 30 into unpressurized reservoir 6. The excess fluid wiped from the reformed fluid layer 9 by doctor blade 26 flows back from intaglio roll 2 along the bottom of doctor blade 26 from where it drops or is conducted by shroud 28 onto the top of pre-wipe member 8. A plurality of apertures 29 extending through pre-wipe member 8 permit the fluid to flow through the pre-wipe means 8 onto deflector 30 and back into the reservoir 6. By flowing the fluid wiped from first layer 7 and second layer 9 back away from the intaglio roll 2, the layers 7 and 9 are not disturbed. By flowing the wiped excess fluids from first layer 7 and reformed layer 9 back into the reservoir 6, the amount of fluid pumped through the recirculating system is reduced, and the capacity of the reservoir to continue applying fluid to the intaglio roll exists for a brief period in the event the pump is purposely or inadvertently out of operation.

Having a description of the preferred embodiments of the invention, modifications and variations within the scope of the invention will be obvious to one skilled in the art. However, it should be understood that the essence of the invention centers on the unique small, unpressurized reservoir with its ability to cleanse the loose fibers from the adhesive in the reservoir and the unique pre-wipe means. Either of these features can be used advantageously without the other, but they are particularly advantageously used together. While the apparatus and method of the invention are particularly advantageous for application of adhesive fluid to soft absorbent fibrous webs, it is to be recognized that they can be used for application of many types of fluids to many types of webs, including applying inks to soft, absorbent fibrous webs, as well as to coated or sized printing papers. The reservoir 6 has been described as preferably being positioned against a lower quadrant of intaglio roll 2 but it is to be recognized that it might be satisfactory for some arrangement to place it in another quadrant.

What is claimed is:

1. Apparatus for applying fluid to fluid carrying recesses of an intaglio roll for subsequent transfer to a soft, absorbent fibrous web passing in contact with the intaglio roll, the apparatus comprising:

a. confining members forming a small unpressurized reservoir of the fluid extending across the width of the intaglio roll, the confining members comprising,
   i. a portion of the intaglio roll,
   ii. a level control member spaced from the intaglio roll and over which the fluid flows continuously out of the reservoir,
   iii. a sealing member positioned close to the intaglio roll below the surface of the reservoir, and
   iv. end confining members sealingly engaging the level control and sealing members at the ends of the reservoir, the upper surface of said fluid reservoir extending from the intaglio roll and being always open to the atmosphere;

b. means for flowing the fluid upwardly through the reservoir at uniform velocity profile across the width of the reservoir;

c. means for rotating the intaglio roll upwardly through the reservoir, whereby a first layer of the fluid is adhered to the roll and lifted above the reservoir;

d. pre-wipe means positioned axially across the surface of the intaglio roll above the reservoir for forcing the fluid into the fluid carrying recesses, for establishing a reformed, thinner and more uniform layer of the fluid adhering to the intaglio roll above the pre-wipe means, and for wiping from the roll a portion of the fluid in the first layer; and e. a doctor blade positioned against the intaglio roll above the pre-wipe means for removing essentially all of the remaining fluid adhering to the intaglio roll except the fluid within the fluid carrying recesses.

2. Apparatus according to claim 1, further including means for conducting the fluid overflowing the level control member through a filter and back into the reservoir.

3. Apparatus according to claim 1, further including means for conducting the fluid wiped from the intaglio roll by the pre-wipe means away from the intaglio roll and back into the reservoir.

4. Apparatus according to claim 3, further including means for conducting the fluid wiped from the intaglio roll by the doctor blade away from the intaglio roll and back into the reservoir.

5. Apparatus according to claim 1, wherein the pre-wipe means comprises a blade which is positioned axially to the intaglio roll surface and forms an acute angle between the pre-wipe blade and the intaglio roll surface with the vertex of the angle in the direction of roll movement, the pre-wipe blade having greater flexibility than the doctor blade.

6. Apparatus according to claim 5, wherein the flexibility of the pre-wipe blade is at least five times that of the doctor blade, the angle between the pre-wipe blade and the surface of the intaglio roll is between about 15° and about 55°, and the angle between the doctor blade and the surface of the intaglio roll is between about 75° and about 85°.

7. Apparatus according to claim 1, wherein the portion of the intaglio roll forming the reservoir is a portion of a lower quadrant of the intaglio roll.

8. Apparatus for applying fluid to a soft, absorbent fibrous web, comprising:

an intaglio roll, having fluid carrying recesses in the surface;

a small unpressurized reservoir of the fluid, the reservoir formed by a portion of the intaglio roll, a sealing member positioned close to and axially across the width of the intaglio roll beneath the surface of the reservoir, a level control member which is spaced from and extending axially to the intaglio roll and which slopes upwardly and away from the intaglio roll to form a dam over which the fluid can continuously flow out of the reservoir, and end confining members sealingly engaging the sealing and level control members at the end of the reservoir, the upper surface of said fluid reservoir extending from the intaglio roll and being always open to the atmosphere;

means to conduct the fluid against the impingement surface and into the reservoir;

means to rotate the intaglio roll upwardly through the reservoir to form a first layer of fluid adhering to the surface of the intaglio roll;

a pre-wipe member positioned axially to and adjacent the intaglio roll above the reservoir for wiping excess fluid from the surface of the intaglio roll and reforming a thinner more uniform layer of the fluid on the surface of the intaglio roll;

a doctor blade in contact with and extending axially to the intaglio roll beyond the prewipe member for removing essentially all of the fluid from the intaglio roll except the fluid in the fluid carrying recesses; and means for bringing the web into contact with the intaglio roll beyond the doctor blade, whereby fluid is transferred from the intaglio roll to the web.

9. Apparatus according to claim 8, further including conduit means, a recirculation pump, and a filter for filtering fibers from the fluid and recirculating the fluid overflowing the dam back into the reservoir.

10. Apparatus according to claim 9, further including means for conducting the flow of excess fluid removed by the pre-wipe member away from the intaglio roll and back into the reservoir.

11. Apparatus according to claim 8, wherein the portion of the intaglio roll forming the reservoir is a portion of a lower quadrant.

12. An improved apparatus for applying fluid to a soft, absorbent fibrous web including an intaglio roll having fluid carrying recesses in the surface, means for rotating the intaglio roll upwardly through a reservoir, means for conducting fluid into the reservoir, and a doctor blade positioned against the intaglio roll and above the reservoir for removing substantially all of the fluid adhering to the intaglio roll and not contained within said recesses, wherein the improvement comprises a small unpressurized reservoir formed by:

a. a portion of the intaglio roll;

b. a sealing member positioned close to and extending across the width of the intaglio roll;

c. a level control member spaced from and extending across the width of the intaglio roll, said level control member sloping gently upward and away from the intaglio roll to form a dam over which fluid flows out of the reservoir;

d. end confining members sealingly engaging the sealing and level control members; and e. an impingement member located at the bottom of the reservoir and extending across the width of the reservoir, against which the incoming fluid is flowed, for providing a uniform flow velocity across the width of the reservoir whereby a first uniform layer of the fluid is adhered to the roll and lifted above the reservoir;

the upper surface of said fluid reservoir extending from the intaglio roll and being always open to the atmosphere, and the flow of fluid through the reservoir and over the level control member flushing loose fibers from the reservoir.

13. An improved apparatus as recited in claim 12 further comprising pre-wipe means positioned axially across the surface of the intaglio roll above the reservoir and before the doctor blade for forcing the fluid into said recesses, for wiping from the roll a portion of the fluid in the first layer, and for establishing a reformed, thinner and more uniform layer of the fluid adhering to the intaglio roll above the pre-wipe means, said pre-wipe means being more flexible than the doctor blade thereby permitting fiber clumps on the intaglio roll to pass beyond the pre-wipe means.

14. An improved apparatus as recited in claim 13 wherein the flexibility of the pre-wipe means is at least five times that of the doctor blade.

* * * * *